US005118988A

United States Patent [19]

della Porta

[11] Patent Number: 5,118,988

[45] Date of Patent: * Jun. 2, 1992

[54] HIGH YIELD WIDE CHANNEL ANNULAR RING SHAPED GETTER DEVICE

[75] Inventor: Paolo della Porta, Milan, Italy

[73] Assignee: SAES Getters SpA, Milan, Italy

[ * ] Notice: The portion of the term of this patent subsequent to Oct. 2, 2007 has been disclaimed.

[21] Appl. No.: 591,273

[22] Filed: Oct. 1, 1990

[30] Foreign Application Priority Data

Oct. 19, 1989 [IT] Italy ..... 22058 A/89

[51] Int. Cl.[5] ..... H01J 29/94; H01J 17/24; H01J 61/26; F04B 37/02

[52] U.S. Cl. ..... 313/561; 313/481; 313/546; 313/553; 417/49

[58] Field of Search ..... 313/481, 561, 560, 562, 313/546, 547, 554, 556, 553, 545; 417/49, 51

[56] References Cited

U.S. PATENT DOCUMENTS 3,428,168 2/1969 Reash ..... 313/481

4,642,516 2/1987 Ward et al. ..... 313/561

4,961,040 10/1990 della Porta et al. ..... 313/561

*Primary Examiner*—Donald J. Yusko

*Assistant Examiner*—John Giust

*Attorney, Agent, or Firm*—David R. Murphy

[57] ABSTRACT

An evaporable getter device, for mounting in an electron tube, comprises a holder whose bottom wall is provided with means for preventing detachment of getter metal vapor releasing material which has been pressed into the holder and which has a multiplicity of means which retard the transmission of heat in a circumferential direction through the getter metal vapor releasing material. When the getter device is heated by currents induced from a radio-frequency field generated by a coil positioned outside the electron tube large amounts of getter metal are released in a short time without detachment of material from the holder. The heat retarding means are preferably four equally spaced radial grooved formed in the upper surface of the getter metal vapor releasing material.

6 Claims, 3 Drawing Sheets

HIGH YIELD WIDE CHANNEL ANNULAR RING SHAPED GETTER DEVICE

BACKGROUND TO THE INVENTION

Annular ring shaped getter devices are well known in the art and have been described, for example, in U.S. Pat. Nos. 3,151,736; 3,381,805 and 3,385,420. In order to have a higher yield of getter metal from such devices it has also been common practice to enlarge or widen the annular channel. Such "wide channel" getter devices have been described in U.S. Pat. Nos. 3,719,433 and 4,642,516.

However, even wide channel getters do not allow the evaporation of getter metal vapours in sufficient quantity without incurring the risk of detachment of getter metal vapour releasing material from its holder or even melting of the getter container walls.

OBJECTS OF THE PRESENT INVENTION

It is therefore an object of the present invention to provide an improved wide channel getter device free from one or more of the disadvantages of prior art wide channel getter devices.

It is another object of the present invention to provide a wide channel getter device having a high yield of getter metal.

A further object of the present invention is to provide a wide channel getter device which does not exhibit melting of the getter container walls.

Yet another object of the present invention is to provide a wide channel getter device free from detachment of getter metal vapour releasing material from its holder.

These and other objects and advantages of the present invention will become apparent to those skilled in the art by reference to the following detailed description thereof and drawing wherein:

BRIEF DESCRIPTION OF THE INVENTION

Figure 1:
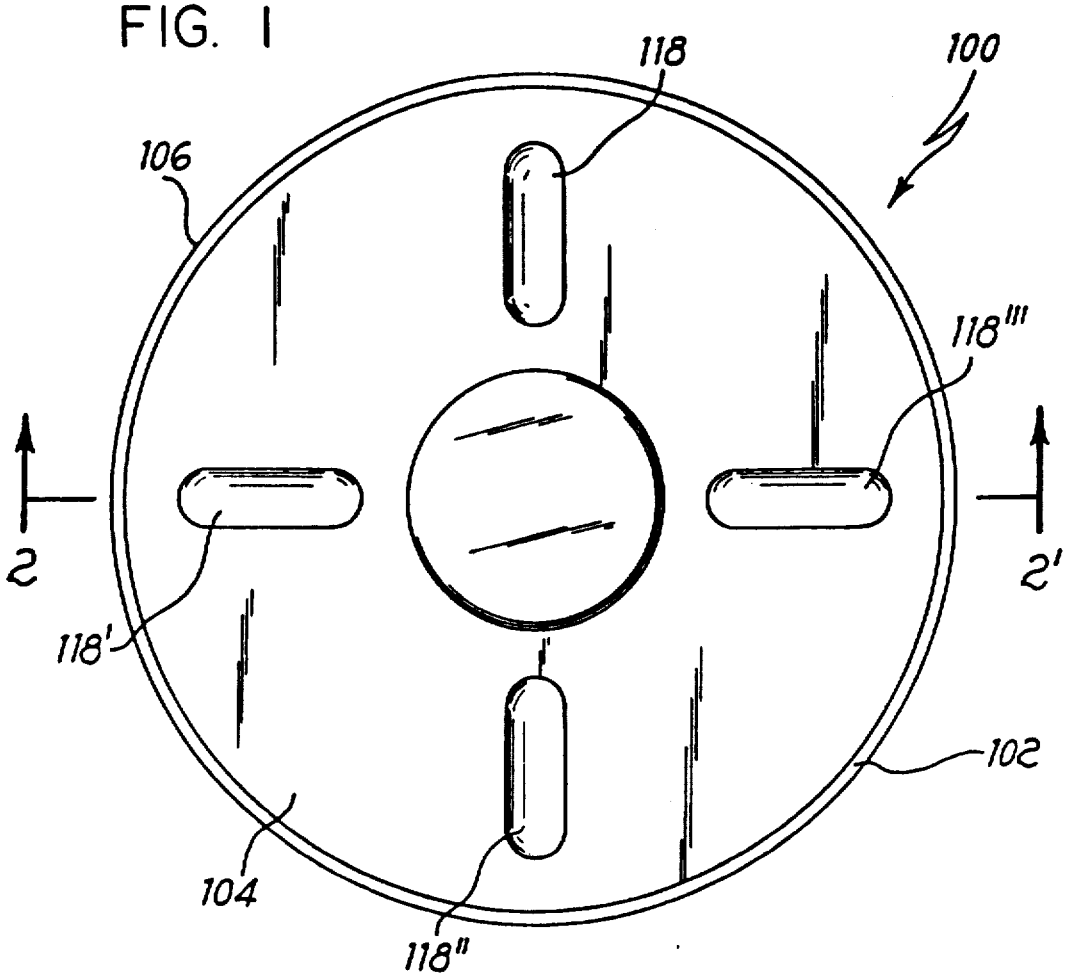
FIG. 1 is a top view of a first preferred embodiment of getter device of the present invention.
Figure 2:
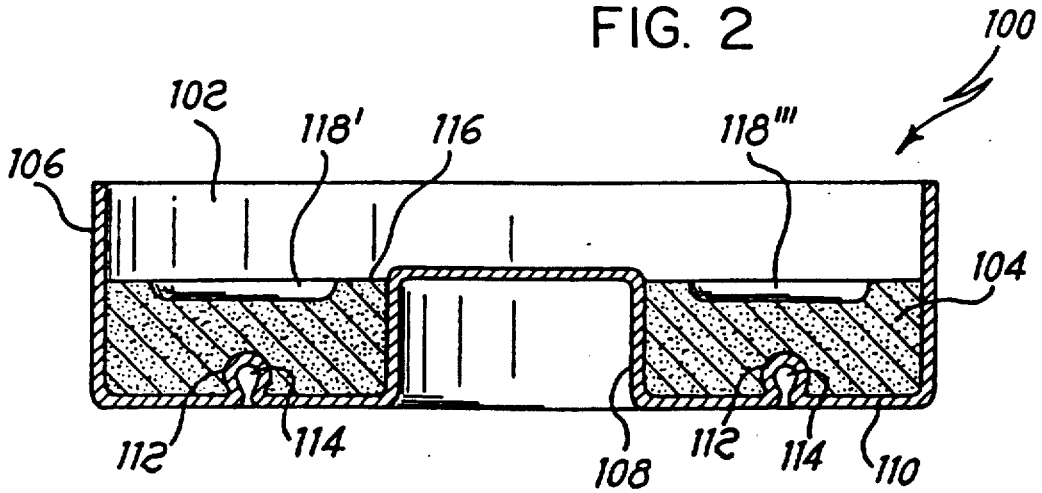
FIG. 2 is a cross-sectional view taken along line 2—32' of FIG. 1.

Referring now to the drawings and in particular to FIGS. 1 and 2, in which identical details are identified by identical numbers, there is shown a first preferred embodiment of an evaporable getter device 100 of the wide channel annular ring shaped type suitable for mounting in an electron tube. Getter device 100 comprises a holder 102, preferably of stainless steel, adapted to support an evaporable getter metal vapour releasing material 104. Holder 102 comprises a vertical outer side wall 106, a vertical inner side wall 108 and a bottom wall 110 which joins said outer side wall 106 to said inner side wall 108. Bottom wall 110 is provided with means 112 for preventing detachment of the getter metal vapour releasing material from the holder. In this first preferred embodiment means 112 is in the form of an annular groove 14 integrally formed in the bottom wall and penetrating into the space formed by outer side wall 106 and inner side wall 108. Annular groove 114 has a generally bulb shaped cross section which narrows down adjacent bottom wall 110.

Getter metal vapour releasing material 104 is supported by holder 102 by pressing it into the space defined by said inner, outer and bottom walls. Getter material 104 comprises an upper surface 116 and a plurality of heat transfer retarding means 118, 118', 118'', 118''' in said upper surface adapted to delay the transfer of heat in a circumferential direction through the getter metal vapour releasing material when the getter device is heated by currents induced from an RF field created by a coil positioned outside the electron tube. Preferably the heat transfer retarding means comprises four equally spaced radial grooves compressed into the upper surface of said getter metal vapour releasing material at least partially penetrating into the space formed by said side wall and said bottom wall. In general the radial grooves have a length longer than their width.

Figure 3:
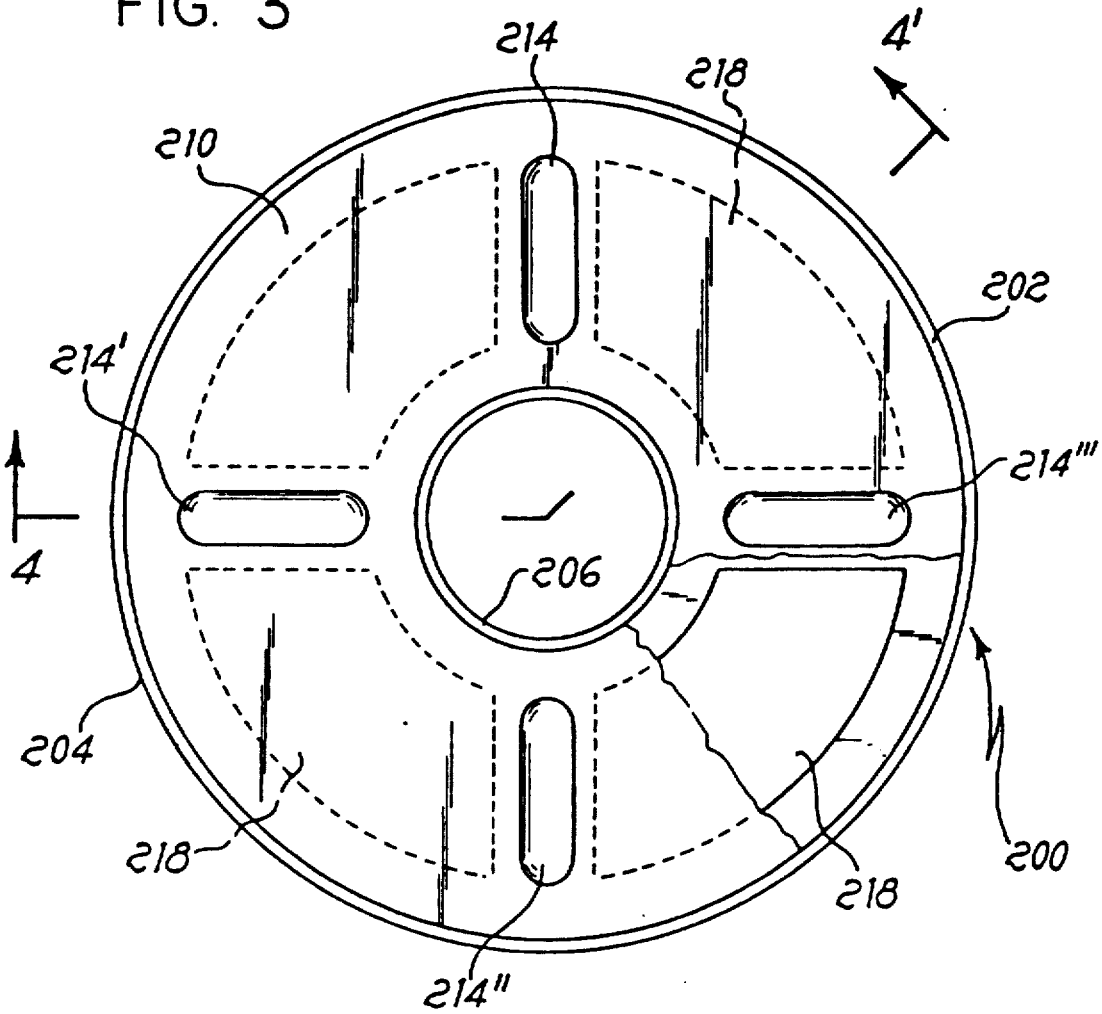
FIG. 3 is a top view of a second preferred embodiment of a getter device of the present invention.
Figure 4:
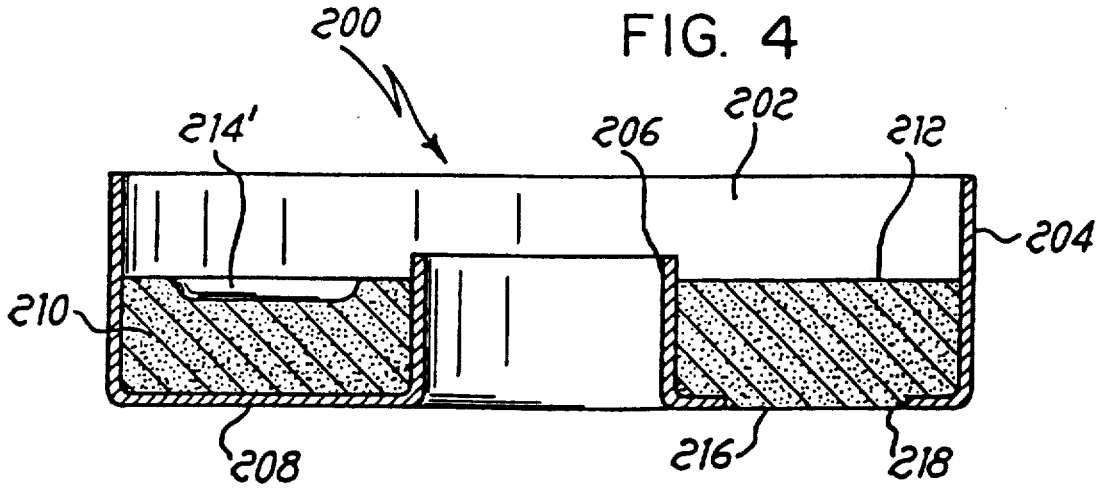
FIG. 4 is a-cross sectional view taken along line 4—4' of FIG. 3.

Referring now to FIGS. 3 and 4 there is shown a second preferred embodiment of an evaporable getter device 200 in the form of a holder 202 having an outer side wall 204 and an inner side wall 206, joined together by a bottom wall 208. Holder 202 supports an evaporable getter metal vapour releasing material 210. Material 210 has an upper surface 212 containing a plurality of heat transfer retarding means 214, 214', 214'', 214'''. Preferably the heat transfer retarding means comprises four equally spaced radial grooves compressed into the upper surface of said getter metal vapour releasing material at least partially penetrating into the space formed by said side wall and said bottom wall. In general the radial grooves have a length longer than their width.

Bottom wall 208 is provided with means 216 for preventing detachment of the getter metal vapour releasing material 210 in the form of a plurality of holes 218 extending through bottom wall 208 and exposing lower surface 218 of getter material 210. This prevents excessive pressure build up between the getter material and bottom wall 208.

EXAMPLE 1

This example is illustrative of the behaviour of prior art getter devices. Thirty getter holders were manufactured having an outer side wall diameter of 15 mm and having an inner side wall diameter of 4 mm. The bottom wall had no annular groove. The holder was filled with 1000 mg of a 50% $BaAl_4$- 50% Ni (by weight) powder mixture. The upper surface was not provided with heat transfer retarding means. The getters were flashed according to American National Standard ASTM F 111-72 in order to determine the barium yield curves. A total time of 35 seconds was used. The yield curves obtained are plotted in FIG. 5 as curve 1. The start time at which the getter containers commenced to melt is indicated by line A.

EXAMPLE 2

Figure 5:
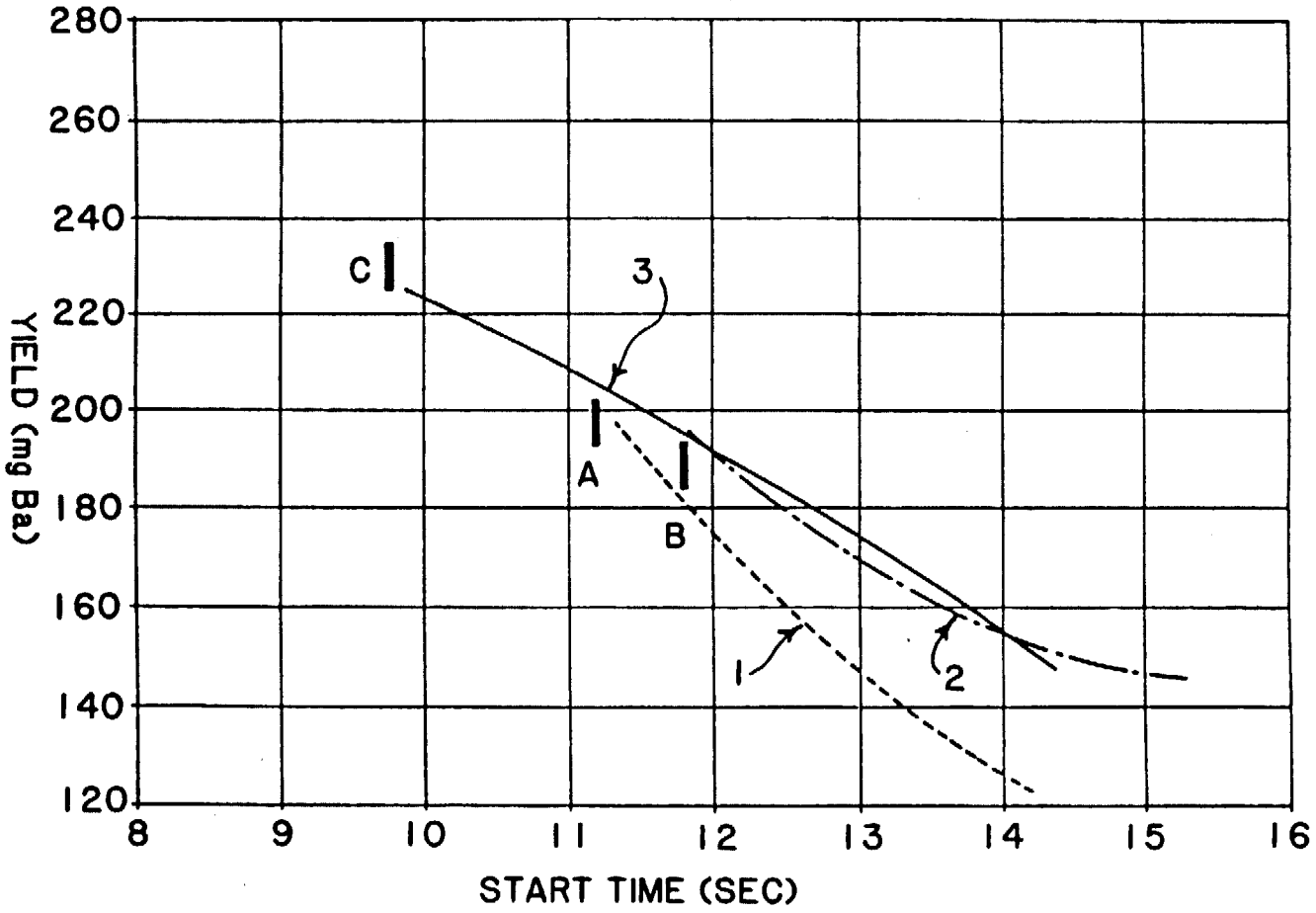
FIG. 5 is a graph comparing the flashing characteristics of getter devices of the present invention with prior art getter devices.

This example is illustrative of the behaviour of further prior art getter devices. Thirty getter devices were produced and flashed exactly as for example 1 except that the bottom wall of the holder was provided with a groove as described in U.S. Pat. No. 4,642,516. The yield curve obtained is shown in FIG. 5 as curve 2. The start time at which the getter containers commence to melt is indicated by line B.

EXAMPLE 3

This example is illustrative of the present invention. Thirty getter devices were manufactured according to example 2 except that the upper surface of the getter powder mixture was provided with heat retarding means as shown in FIGS. 1 and 2. The yield curves obtained are shown in FIG. 5 as curve 3. The start time at which the getter containers commenced to melt is indicated by line C.

EXAMPLE 4

This example is illustrative of the present invention. Thirty getter devices are manufactured according to example three except that the groove in the bottom wall was replaced by holes as shown in FIGS. 3 and 4. The results are found to be identical with curve 3 and point C on FIG. 5.

DISCUSSION

As can be seen from FIG. 5 the prior art getter devices of Examples 1 and 2 start to melt when the getter metal (barium) yield is only slightly greater than 180 mg which is only about 72% of the barium content of the getter device (250 mg).

Getter devices of the present invention can yield approximately 230–240 mg of barium before starting to melt which is from 92–96% of the barium content.

The term "getter metal vapour releasing material" as used in the specification and claims herein is meant to include both the material prior to and after getter metal vapour release. This term embraces both the material in the form sold with the getter device and in the form in which it is found in an operating tube wherein the bulk of the getter metal has been evaporated from the material and is in the form of a film on the inside surfaces of the tube.

Although the invention has been described in considerable detail with reference to certain preferred embodiments designed to teach those skilled in the art how best to practice the invention, it will be realized that other modifications may be employed without departing from the spirit and scope of the appended claims.

What is claimed is:

1. An evaporable getter device for mounting in an electron tube comprising:

A) A holder for supporting an evaporable getter metal vapour releasing material, said holder comprising;
   i) a vertical outer side wall, and
   ii) a vertical inner side wall, and
   iii) a bottom wall joining said inner side wall and said outer side wall, said bottom wall provided with means for preventing detachment of the getter metal vapour releasing material from the holder; and B) An evaporable getter metal vapour releasing material supported by said holder and pressed into the space defined by said inner, outer and bottom walls, said getter vapour releasing material comprising:
   i) an upper surface; and
   ii) a plurality of heat transfer retarding means in said upper surface adapted to delay the transfer of heat in a circumferential direction through the getter metal vapour releasing material when the getter device is heated by currents induced from an RF field created by a coil positioned outside the electron tube.

2. A getter device of claim i in which the heat transfer retarding means comprises four equally spaced radial grooves compressed into the upper surface of said getter metal vapour releasing material at least partially penetrating into the space formed by said sidewalls and said bottom wall.

3. A getter device of claim 2 in which the radial grooves have a length longer than their width.

4. A getter device of claim 1 in which the means for preventing detachment of the getter material vapour releasing material from the holder is an annular groove integrally formed in the bottom wall and penetrating into the space formed by said sidewalls and said bottom wall, said annular groove having a generally bulb shaped cross section which narrows down adjacent said bottom wall.

5. A getter device of claim 1 in which the means for preventing detachment of the getter metal vapour releasing material from the holder is in the form of a plurality of holes extending through said bottom wall.

6. An evaporable getter device for mounting in an electron tube comprising:

A) A holder for supporting an evaporable getter metal vapour releasing material, said holder comprising;
   i) a vertical outer side wall, and
   ii) a vertical inner side wall, and
   iii) a bottom wall joining said inner side wall and said outer side wall, said bottom wall provided with means for preventing detachment of the getter metal vapour releasing material from the holder; and B) An evaporable getter metal vapour releasing material supported by said holder and pressed into the space defined by said inner, outer and bottom walls, said getter vapour releasing material comprising:
   i) an upper surface; and
   ii) a plurality of heat transfer retarding means in said upper surface adapted to delay the transfer of heat in a circumferential direction through the getter metal vapour releasing material when the getter device is heated by currents induced from an RF field created by a coil positioned outside the electron tube;

Wherein the heat transfer retarding means comprises four equally spaced radial grooves compressed into the upper surface of said getter metal vapour releasing material at least partially penetrating into the space formed by said sidewalls and said bottom wall; and Wherein the radial grooves have a length longer than their width; and Wherein the means for preventing detachment of the getter metal vapour releasing material from the holder is an annular groove integrally formed in the bottom wall and penetrating into the space formed by said sidewalls and said bottom wall, said annular groove having a generally bulb shaped cross section which narrows down adjacent said bottom wall; and Wherein the means for preventing detachment of the getter metal vapour releasing material from the holder is in the form of a plurality of holes extending through said bottom wall.

* * * * *